US011013271B2

(12) United States Patent
Ding et al.

(10) Patent No.: US 11,013,271 B2
(45) Date of Patent: May 25, 2021

(54) MULTIPLE-TAR-CABIN ELECTRONIC CIGARETTE

(71) Applicant: ALD GROUP LIMITED, Shenzhen (CN)

(72) Inventors: Yi Ding, Shenzhen (CN); Pan Li, Shenzhen (CN); Hao Du, Shenzhen (CN)

(73) Assignee: ALD GROUP LIMITED, Shenzhen (CN)

( * ) Notice: Subject to any disclaimer, the term of this patent is extended or adjusted under 35 U.S.C. 154(b) by 250 days.

(21) Appl. No.: 16/362,517

(22) Filed: Mar. 22, 2019

(65) Prior Publication Data

US 2019/0313696 A1 Oct. 17, 2019

(30) Foreign Application Priority Data

Apr. 17, 2018 (CN) ..... 201810343196.2

(51) Int. Cl.
*F22B 1/28* (2006.01)
*A24F 47/00* (2020.01)

(52) U.S. Cl.
CPC ..... *A24F 47/008* (2013.01)

(58) Field of Classification Search
CPC ..... C23C 16/4481; F22B 1/282
USPC ..... 165/164; 392/450
See application file for complete search history.

(56) References Cited

U.S. PATENT DOCUMENTS

2020/0305502 A1* 10/2020 Ouyang ..... A24F 47/00
2020/0367572 A1* 11/2020 Hejazi ..... H05B 3/12
2020/0411839 A1* 12/2020 Wang ..... H01M 4/0419
2021/0000174 A1* 1/2021 Huang ..... A24F 40/10
2021/0000178 A1* 1/2021 Chen ..... A24F 40/42

* cited by examiner

*Primary Examiner* — Phuong Chi Thi Nguyen
(74) *Attorney, Agent, or Firm* — JCIP Global Inc.

(57) ABSTRACT

The invention relates to a multiple-tar-cabin electronic cigarette, comprising an atomizer and a battery assembly. The battery assembly supplies electricity to the atomizer. The atomizer comprises tar cabins and heaters that are arranged in a housing. The tar cabins supply tobacco tar to the heaters. After the heaters atomize the tobacco tar, the atomized tobacco tar is brought away by air that enters via an air inlet of the housing, and is smoked via a cigarette holder. The tar cabins include a first tar cabin and a second tar cabin that are mutually isolated. The heaters include a first heater that receives the tobacco tar from the first tar cabin and a second heater that receives the tobacco tar from the second tar cabin. The two tar cabins in the invention can be injected with tobacco tar of different tastes. In this way, users can enjoy cigarettes of different tastes.

7 Claims, 2 Drawing Sheets

MULTIPLE-TAR-CABIN ELECTRONIC CIGARETTE

BACKGROUND OF THE INVENTION

Technical Field

The invention relates to the field of electronic cigarettes, in particular to a multiple-tar-cabin electronic cigarette.

Description of Related Art

Electronic cigarettes are used for the main purpose of quitting smoking and replacing cigarettes. The electronic cigarettes share identical appearance and similar smell with cigarettes, and even have more tastes than the cigarettes have. Like cigarettes, electronic cigarettes can also produce smoke, tastes and feeling.

At present, electronic cigarettes have rich tastes which are determined according to different tobacco tar formulas. The tastes vary with formulas. A formula determines the taste of a type of tobacco tar. To obtain different tastes with one electronic cigarette, it needs to replace different types of tobacco tar. To obtain a feeling that the smoke is a mixture of different tastes, the tobacco tars of different taste formulas are required to be mixed. However, mixing tobacco tars of different tastes may cause chemical changes and bring unexpected results, which may fail to meet the requirement of mixing different tastes.

This is because the current electronic cigarette only has one tar cabin, and one atomizer can be filled in with the tobacco tar of one taste only. To obtain more tastes, more atomizers are required, which brings inconvenience, increases cost, fails to obtain the mixed taste of two types of tobacco tar, and fails to meet user demands on smoking with two or more tastes.

BRIEF SUMMARY OF THE INVENTION

The invention provides a multiple-tar-cabin electronic cigarette to overcome the defect that the current electronic atomizer can only carry one tar cabin.

The invention adopts the following technical solution: A multiple-tar-cabin electronic cigarette includes an atomizer and a battery assembly; the battery assembly supplies electricity to the atomizer; the atomizer includes tar cabins and heaters that are arranged in a housing; the tar cabins supply tobacco tar to the heaters; after the heaters atomize the tobacco tar, the atomized tobacco tar is brought away by air that respectively enters via two air inlets of the bottom cover and is smoked via a cigarette holder; the tar cabins include a first tar cabin and a second tar cabin that are mutually isolated; the heaters include a first heater that receives the tobacco tar from the first tar cabin and a second heater that receives the tobacco tar from the second tar cabin.

The two tar cabins in the invention can be injected with tobacco tar of different tastes. In this way, a person can enjoy cigarettes of different tastes.

Further, in the multiple-tar-cabin electronic cigarette, the air inlets include a first air inlet communicated with the first heater and a second air inlet communicated with the second heater, the first heater and the second heater are arranged forward and backward side by side, air input via the first air inlet passes through the first heater while input via the second air inlet passes through the second heater, and the air is gathered at the position of a middle ventilation pipe and is finally smoked via the cigarette holder.

Further, in the multiple-tar-cabin electronic cigarette, electrodes of the first heater and the second heater are connected in series between two poles of a battery.

Further, in the multiple-tar-cabin electronic cigarette, electrodes of the first heater and the second heater are connected in parallel between two poles of the battery assembly.

Further, in the multiple-tar-cabin electronic cigarette, an opening of the first tar cabin and an opening of the second tar cabin are arranged left and right side by side and share one sealing body, and the sealing body is internally provided with a first tar guide that guides tobacco tar in the first tar cabin onto the first heater and a second tar guide that guides tobacco tar in the second tar cabin onto the second heater.

Further, in the multiple-tar-cabin electronic cigarette, the first heater and the second heater are mounted at positions, corresponding to the tar cabins, of a heater bracket, the heater bracket and the sealing body are assembled and arranged on a bottom cover, and the bottom cover at the opening is fastened with the housing.

Further, in the multiple-tar-cabin electronic cigarette, the bottom cover is respectively provided with liquid injecting holes that connect the first tar cabin and the second tar cabin with the outside world; each one of the liquid injecting holes is internally provided with a liquid plug; the heater bracket is provided with an electrode column that is electrically connected with each one of the electrodes, and the other end of each one of the electrode columns is connected with a battery assembly.

The invention is described in further detail in conjunction with the attached drawings and specific embodiments.

DETAILED DESCRIPTION OF THE INVENTION

Figure 1:
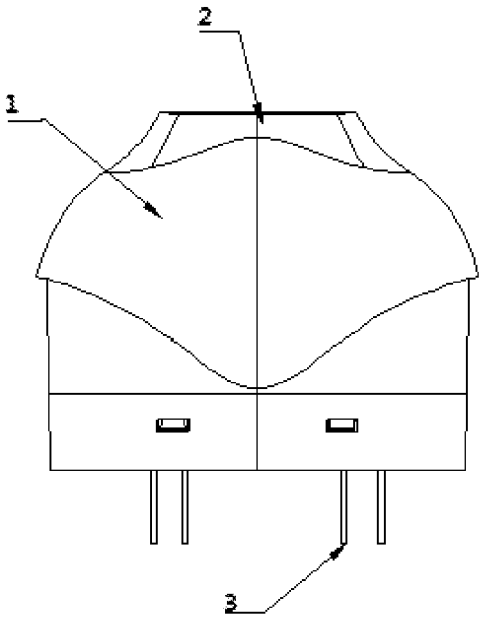
FIG. 1 is a front view of an atomizer of an electronic cigarette of the invention.
Figure 2:
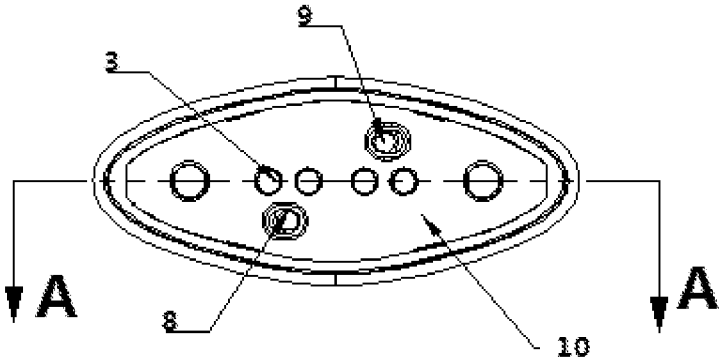
FIG. 2 is a bottom view of an atomizer of an electronic cigarette of the invention.
Figure 3:
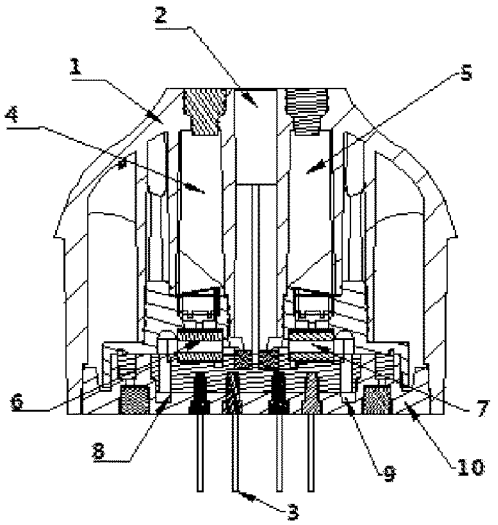
FIG. 3 is an A-A sectional view of FIG. 2.

This embodiment provides an electronic cigarette with two tar cabins, like existing electronic cigarettes, the electronic cigarette of this embodiment has a battery assembly 30 and an atomizer. The battery assembly 30, like the battery of the existing electronic cigarette, supplies electricity only to the atomizer, and sometimes supplies a control signal to control the electronic cigarette. The atomizer, as shown in FIGS. 1, 2 and 3, is different from the atomizer of the existing electronic cigarette in having two tar cabins, namely a first tar cabin 4 and a second tar cabin 5, and correspondingly, has two heaters, namely a first heater 6 that receives tar from the first tar cabin 4 and a second heater 7 that receives tar from the second tar cabin 5. As shown in FIG. 3, the two tar cabins are mutually isolated, so that tobacco tar of different tastes can be placed in the two tar cabins, thus preventing the tobacco tar from being mixed during storage. A sealing material for preventing the tobacco tar from spilling over or evaporating is arranged at an opening of each one of the tar cabins. For example, a sealing body 13 is arranged at the opening of the first tar cabin 4 and is also arranged at the opening of the second tar cabin 5, which means that only one sealing body 13 is configured, and the sealing body can seal the tobacco tar in the two tar cabins. In use, the tobacco tar in the tar cabins is guided to respective heaters by respective tar guides. In this embodiment, the sealing body 13 is internally provided with a first tar guide 11 that guides the tobacco tar in the first tar cabin 4 onto the first heater 6, and a second tar guide 12 that guides the tobacco tar in the second tar cabin 5 onto the second heater 7 is arranged at the bottom of the corresponding tar cabin of the sealing body 13. In this way, the tobacco tar is mutually isolated in the process of being guided onto the heaters. The tobacco tar of different tastes is mutually isolated in the liquid state in the tar cabins, and only the smoke is mixed together after the tobacco tar is atomized on the heaters, so that the smoke of different tastes is directly fully mixed to meet the demands of people with such favorites.

In this embodiment, the atomizer has two groups of heaters inside, and each group of the heaters correspondingly atomizes the tobacco tar in a tar cabin. In this embodiment, a heater bracket and a sealing body are arranged below two corresponding tar cabins; the two heaters share the heater bracket and the sealing body. In this embodiment, the heater bracket and the sealing body corresponding to the bottoms of the tar cabins 4 and 5 respectively form a whole body. The heater bracket and the sealing body below corresponding tar cabins are respectively internally provided with the first heater 6 and the second heater 7. The heater bracket 15 is close to the sealing body 13. The heater bracket 15 supports the first heater 6, and provides a space where the first heater 6 atomizes the tobacco tar thereon; one end of the first tar guide 11 extends to the first tar cabin 4, and the other end extends into the bottom of the first tar cabin 4 corresponding to the heater bracket 15 to guide the tobacco tar therein onto the first heater 6. Similarly, the heater bracket 15 is close to the sealing body 13; the heater bracket 15 supports the second heater 7 and provides space where the second heater 7 heats and atomizes the tobacco tar thereon; one end of the second tar guide 12 extends into the second tar cabin 5, and the other end extends to the bottom of the tar cabin 5 corresponding to heater bracket 15 and can guide the tobacco tar therein onto the second heater 7.

Figure 4:
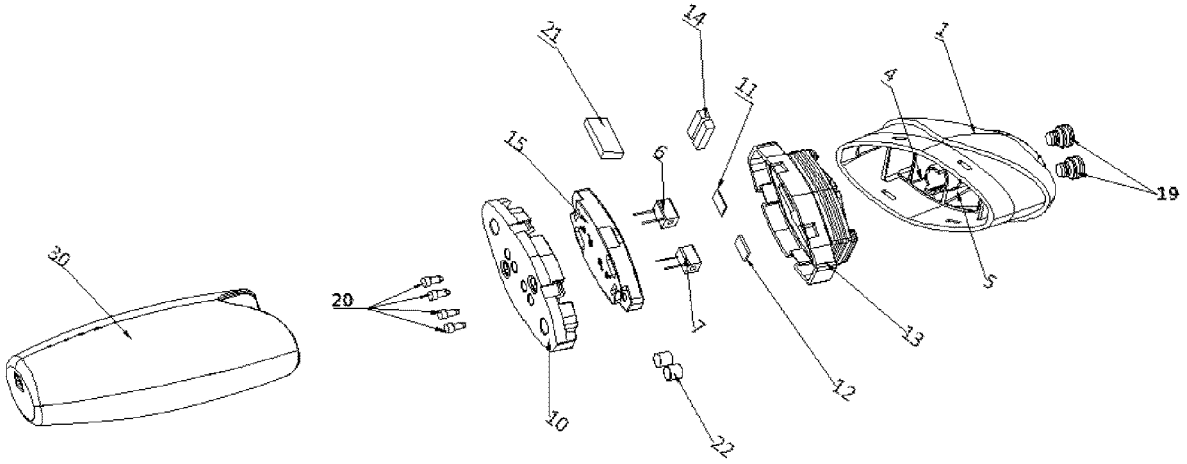
FIG. 4 is an exploded view of the electronic cigarette in embodiment 1 of the invention.

A cover for assembling with the lower end of the housing is required to be installed at the lower end of the housing of the atomizer. In the housing of the atomizer, the first tar cabin 4 and the second tar cabin 5 are sealed with the sealing body 13. The heater bracket 15 is mounted on the bottom cover 10; the sealing body 13 is pressed against the heater bracket 15; and finally, the bottom cover 10 is fastened in a cup body, as shown in FIG. 4. In this embodiment, the atomizer is sealed in the housing 1, wherein two tar cabins are entirely encapsulated to avoid leaks. In order to inject tobacco tar into the tar cabins, in this embodiment, two liquid injecting holes that respectively connect the first tar cabin 4 and the second tar cabin 5 with the outside world are formed on the end face of the top of the housing 1, and are respectively blocked with a liquid plug 19 in ordinary days. When adding the tobacco tar is needed, the liquid plugs 19 are removed, and the tobacco tar is injected into the tar cabins using syringes.

In addition, the bottom cover 10 is also provided with two ventilation channels that connect the heater bracket 15 with the outside world; the heater bracket 15 is internally provided with an electrode column 20 that is electrically connected with each one of the electrodes 3, and the other end of each one of the electrode columns 20 is connected with the battery assembly 30, ensuring that the battery assembly supplies electricity to the two heaters. In addition, in this embodiment, the battery assembly is also provided with a control circuit board that uses the two electrodes 3 to realize control over the heaters, for example the time of switching on or off the heaters.

In this embodiment, the bottom cover is formed with two air inlets which are respectively a first air inlet 8 that inputs outside fresh air into the first heater 6 and a second air inlet 9 that inputs outside fresh air into the second heater 7. The fresh air enters the bottom cover 10 via the two air inlets, reaches the middle between the heater brackets, takes away the smoke generated by the atomizer, flows into a middle ventilation pipe of the housing, and finally flows into the cavity of a user via the cigarette holder 2.

In this embodiment, the two tar cabins are mutually isolated, and the two heaters may be in the following several connection relationships:

First, the connection relationship refers to the output of the two atomizers, namely the relationship of the output smoke. In the first type of relationship, the first heater 6 and the second heater 7 are arranged forward and backward side by side, and the air input via the first air inlet 8 and the second air inlet 9 respectively passes through the first heater 6 and the second heater 7 and then flows into the cavity of the user via the cigarette holder 2. Here, the connection relationship may be parallel connection. The air input via the first air inlet 8 and the second air inlet 9 is divided into two parts, one entering the first heater 6 and after the smoke comes out from the first heater 6 flowing toward the cigarette holder 2, and the other entering the second heater 7 and after the smoke comes out from the second heater 7 also flowing toward the cigarette holder 2, and the smoke brought by the two parts of air is mixed in the pipe to the cigarette holder 2.

The other connection relationship is as follows: the first heater 6 and the second heater 7 are arranged left and right side by side, and the air input via the first air inlet 8 passes through the first heater 6 first, then passes through the second heater 7 and finally flows into the cavity of the user via the cigarette holder 2. Here, outputs of the two heaters may be connected in series. Fresh air enters via the first air inlet 8, flows to one of the heaters, then flows out, enters the other heater, and finally reaches the cigarette holder 2. The air is a flow of hybrid tastes. The smoke of two tastes is mixed at the second heater. This connection relationship can be called smoke series-connection mode.

Second, the electric connection relationship refers to the electrical connection relationship of two heaters, including series connection and parallel connection modes. The electrodes 3 of the first heater 6 and the second heater 7 are connected in series between two poles of a battery. In this way, when the two heaters are of the same model, they will have the same power, each sharing half voltage. Moreover, the two heaters can only work, and the control process is relatively simple. The electrodes of the first heater 6 and the second heater 7 are connected in parallel between the two poles of the battery assembly, thus ensuring respective control. The battery assembly 30 is internally provided with a circuit board for performing relatively complicated control.

What is claimed is:

1. A multiple-tar-cabin electronic cigarette, comprising an atomizer and a battery assembly (30), wherein the battery assembly (30) supplies electricity to the atomizer; the atomizer comprises tar cabins and heaters that are arranged in a housing (1); the tar cabins supply tobacco tar to the heaters; after the heaters atomize the tobacco tar, the atomized tobacco tar is brought away by air that enters via air inlets of a bottom cover (10) and is smoked via a cigarette holder (2); characterized in that the tar cabins include a first tar cabin (4) and a second tar cabin (5) that are mutually isolated; and the heaters include a first heater (6) that receives the tobacco tar from the first tar cabin (4) and a second heater (7) that receives the tobacco tar from the second tar cabin (5).

2. The multiple-tar-cabin electronic cigarette according to claim 1, wherein the air inlets includes a first air inlet (8) communicated with the first heater (6) and a second air inlet (9) communicated with the second heater (7), the first heater (6) and the second heater (7) are arranged forward and backward side by side, and the air input via the first air inlet (8) passes through the first heater (6) while the air input via the second air inlet (9) passes through the second heater (7), and the air is gathered at the position of a middle ventilation pipe and is finally smoked via the cigarette holder (2).

3. The multiple-tar-cabin electronic cigarette according to claim 1, wherein electrodes (3) of the first heater (6) and the second heater (7) are connected in series between two poles of a battery.

4. The multiple-tar-cabin electronic cigarette according to claim 1, wherein electrodes of the first heater (6) and the second heater (7) are connected in parallel between two poles of a battery assembly.

5. The multiple-tar-cabin electronic cigarette according to claim 1, wherein an opening of the first tar cabin (4) and an opening of the second tar cabin (5) are arranged left and right side by side and share a sealing body (13), and the sealing body (13) is internally provided with a first tar guide (11) that guides tobacco tar in the first tar cabin (4) onto the first heater (6); the sealing second body (13) is share at an opening of the second tar cabin (5) and a second tar guide (12) that guides tobacco tar in the second tar cabin (5) onto the second heater (7).

6. The multiple-tar-cabin electronic cigarette according to claim 5, wherein the first heater (6) and the second heater (7) are mounted at positions, corresponding to the tar cabins, of a heater bracket (15), the heater bracket (15) and the sealing body (13) are assembled and arranged on a bottom cover (10), and the bottom cover (10) at the opening is fastened with the housing (1).

7. The multiple-tar-cabin electronic cigarette according to claim 6, wherein the bottom cover (10) is respectively provided with liquid injecting holes that connect the first tar cabin (4) and the second tar cabin (5) with the outside world; each one of the liquid injecting holes is internally provided with a liquid plug (19); the heater bracket (15) is provided with an electrode column (20) that is electrically connected with each one of the electrodes (3), and the other end of each one the electrode columns (20) is connected with the battery assembly (30).

* * * * *